United States Patent [19]

Bako

[11] 3,952,561

[45] Apr. 27, 1976

[54] COMBINATION LOCK IN A LUGGAGE CASE HANDLE STUD

[75] Inventor: Lazlo Bako, Woodcliff Lake, N.J.

[73] Assignee: Presto Lock Company, Elmwood Park, N.J.

[22] Filed: Nov. 5, 1974

[21] Appl. No.: 521,042

[52] U.S. Cl. ..... 70/70; 70/312; 70/316

[51] Int. Cl.[2] ..... E05B 65/52; E05B 37/02

[58] Field of Search ..... 70/63, 64, 66, 67, 70, 70/288, 312, 316, 318

[56] References Cited

UNITED STATES PATENTS

| | | | |
|---|---|---|---|
| 834,310 | 10/1906 | Lievens et al. | 70/312 |
| 1,606,279 | 11/1926 | Wildrick | 70/312 |
| 3,405,544 | 10/1968 | Gehrie | 70/74 |
| 3,452,563 | 7/1969 | Atkinson | 70/312 |

*Primary Examiner*—Albert G. Craig, Jr.
*Attorney, Agent, or Firm*—Shapiro and Shapiro

[57] ABSTRACT

A multiple dial type combination lock in a luggage case handle stud employs an elongated, longitudinally movable puller formed to engage a cooperable hasp and having longitudinally spaced slots receiving dials. The dials, which are keyed for rotation with associated sleeve means by interfitting teeth, are cooperable with respective lugs on the puller for blocking movement of the puller from latching position when the dials are off combination. Each sleeve means has a missing tooth portion for receiving the respective lug on the puller when the dials are on combination, thereby permitting movement of the puller between latching and unlatching positions, the dials being shifted longitudinally with the puller during this motion. In the preferred embodiment, the opening combination may be set to a combination of one's own choice.

11 Claims, 5 Drawing Figures

COMBINATION LOCK IN A LUGGAGE CASE HANDLE STUD

The invention relates to combination locks, and is more particularly directed to an improved multiple dial type combination lock for use in the handle stud of a luggage case or the like.

BACKGROUND OF THE INVENTION

In the multiple dial type combination lock disclosed in Gehrie U.S. Pat. No. 3,439,515, a latch member formed to engage a cooperable hasp is movable longitudinally to latching and unlatching positions by means of a dead-bolt action puller which is slidably supported on the face plate of the lock. Combination dials rotatable with associated sleeve means extend through respective longitudinally spaced slots provided in the face plate off to one side of the puller. The latch member has slots aligned with but wider than the face plate slots for receiving respective dials, these slots being cooperable with flanges and flat portions on the sleeve means for locking the latch member in latching position when the dials are off combination and for permitting movement of the latch member between latching and unlatching positions by means of the puller when the dials are on combination.

Combination locks constructed in accordance with the aforementioned Gehrie patent have been satisfactory for use in connection with luggage. When the lock is applied to the center of one of the cooperable sections of a hinged case, such as a luggage case, the puller can be conveniently moved in the direction away from the dials by thumb pressure to unlatch the case. In closing the case, it is common practice for the user to place his hands on the case in positions on opposite sides of the lock and spaced from the lock so that the luggage case sections can be drawn together by the force applied between the palm and the fingers of each hand. In fact, when the case is overpacked, this may be the only satisfactory method of closing the case. However, with the hands so positioned the puller cannot be conveniently actuated to latch the luggage case sections together, because the hand best suited to apply thumb pressure to draw the puller toward the dials to latching position is on the side of the lock opposite the side having the puller. As a result, the hand must be moved to a position closely adjacent to or even overlying a portion of the lock so as to enable the thumb to engage the puller. Such movement is especially awkward when the luggage case is overpacked.

SUMMARY OF THE INVENTION

A principal object of the invention is to provide an improved combination lock for securing together the cooperable sections of hinged containers, such as luggage cases, and more particularly to provide an improved combination lock of the type having multiple combination dials for controlling movement of a dead bolt action puller.

Another object of the invention is to provide a combination lock of the above-described type which, when mounted at the center of a luggage case section, permits the puller to be conveniently moved to latching and unlatching positions by thumb pressure.

Still another object of the invention is to provide a handle stud employing a combination lock of the above-described type.

A combination lock constructed in accordance with the invention employs a longitudinally movable puller formed to engage an associated hasp, the puller having a plurality of longitudinally spaced slots therein receiving respective rotatable dials which are movable with the puller. Means cooperable with the dials prevents movement of the puller from latching position to unlatching position when the dials are off combination and permits movement of the puller to unlatching position when the dials are on combination. In the preferred lock, each dial is keyed for rotation with an associated sleeve means by interfitting teeth which permit longitudinal movement of the dials relative to their associated sleeve means, the teeth on the sleeve means being cooperable with respective lugs on the puller for controlling movement of the puller. When the dials are off combination, the teeth on the sleeve means, which are stationary, are aligned with the lugs to block movement of the puller from latching position. When the dials are on combination, a "missing tooth" portion on each sleeve means is aligned to receive an associated lug on the puller, thereby permitting longitudinal movement of the puller to unlatching position. Means is provided for setting the opening combination to a combination of one's own choice.

In a luggage case handle stud constructed in accordance with a preferred embodiment of the invention and employing the combination lock of the invention, the slots through which the dials extend are provided in a rectilinear central portion of the puller, the opposite end portions of the puller sloping upwardly away from the central portion to provide surfaces for manual engagement. Longitudinally spaced, facing recesses in the handle stud receive opposite ends of the puller.

The above-described and advantages of the invention as well as other advantages and improved results will be apparent from the following detailed description of the invention.

Description of the Preferred Embodiment

Figure 2:
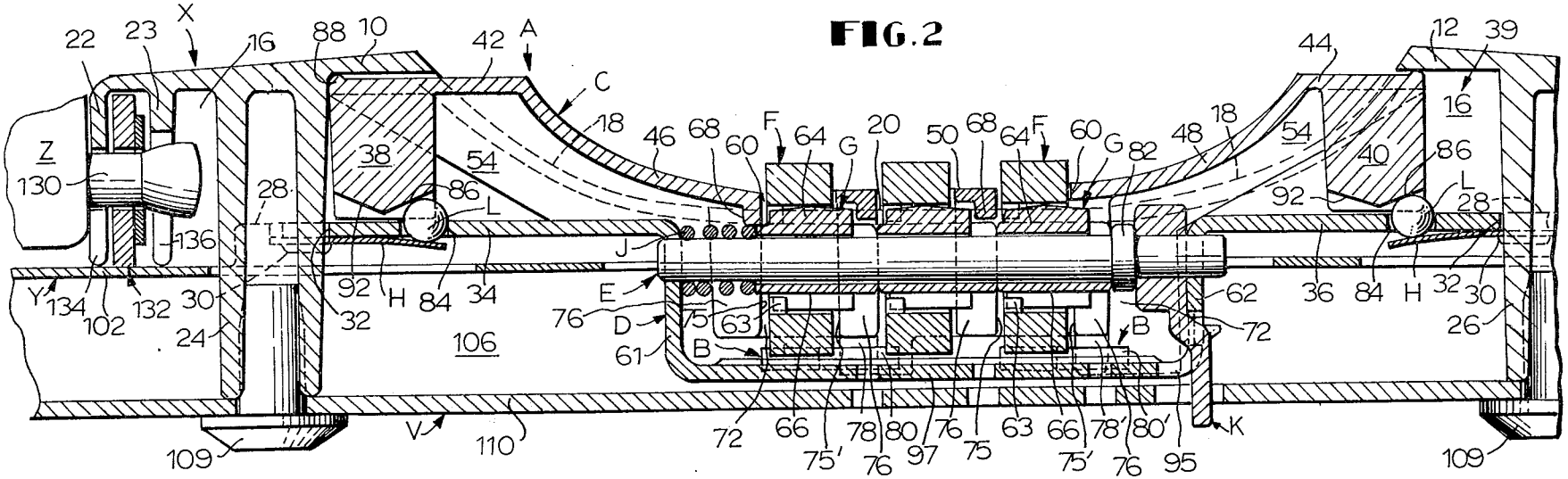
FIG. 2 is a partial longitudinal cross-sectional view taken approximately in the plane of line 2—2 of FIG. 1, this view partially showing a handle connected to the handle stud.

Referring to the drawings, a combination lock A constructed in accordance with the invention and cooperable with an associated hasp B is shown incorporated into the handle stud X of a luggage case or the like. Referring to FIG. 2, the combination lock essentially comprises a longitudinally movable puller C, a frame D, a longitudinally extending shaft E, rotatable dials F and associated sleeve means G. For convenience of manufacture, the handle stud and the puller are preferably made by die casting.

Figure 1:
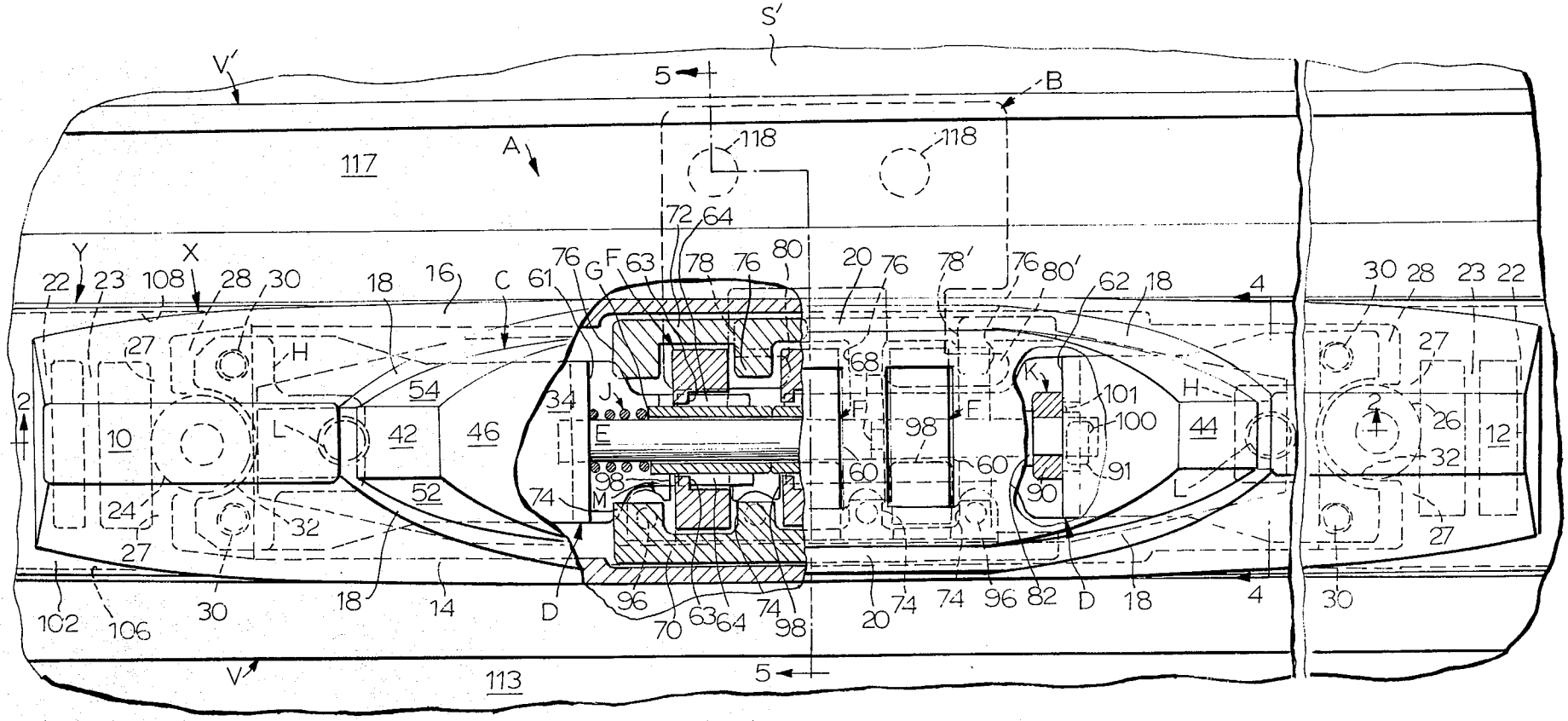
FIG. 1 is a top plan view, with certain of the parts broken away for clarity of illustration, of a combination lock constructed in accordance with the invention incorporated into a handle stud on one of the cooperable sections of a luggage case, this view showing the puller in latching position in engagement with a hasp provided by the other luggage case section.
Figure 4:
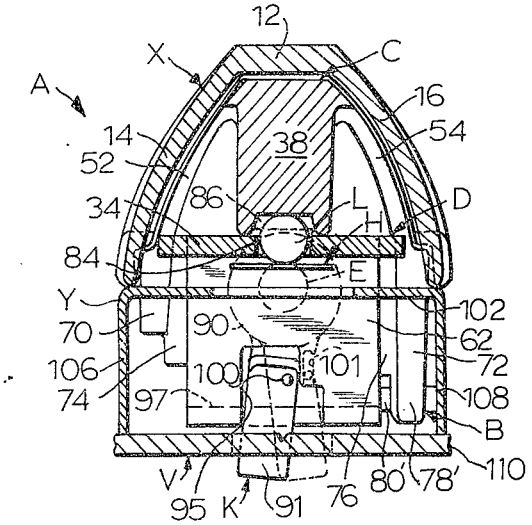
FIG. 4 is a transverse cross-sectional view of the latching device taken approximately in the plane of line 4—4 of FIG. 1.

Referring to FIGS. 1 and 2, handle stud X comprises an elongated body having longitudinally spaced, narrow top wall portions 10 and 12 which are joined together by transversely spaced, downwardly divergent side walls 14 and 16 (see FIG. 4). As shown in FIG. 2, the top edge of each side wall slopes curvilinearly downward at 18 from top wall portions 10 and 12 to meet respective opposite ends of a central rectilinear edge region 20 (see FIG. 5), in which region the height of each side wall is at its minimum. Referring to FIG. 1, at each end of the handle stud is a transverse outer end wall 22 and a transverse inner end wall 23 spaced a short distance therefrom. Hollow connecting studs 24 and 26 (see FIG. 2) project perpendicularly from top wall portions 10 and 12, respectively, near inner walls 23 to enable connection of the handle stud to a luggage case in a manner to be described later. Transverse wall portions 27 (FIG. 1) merge with the connecting studs to provide an additional transverse inner wall.

As shown in FIG. 1, opposite ends of frame D of the combination lock are secured to respective shoulders 28 (see FIG. 2) of the handle stud by headed-over studs 30, which also function to secure leaf springs H (described in detail later) against the frame. Each end of the frame has a semi-circular cut-away portion 32 to provide clearance for connecting studs 24 and 26.

Figure 5:
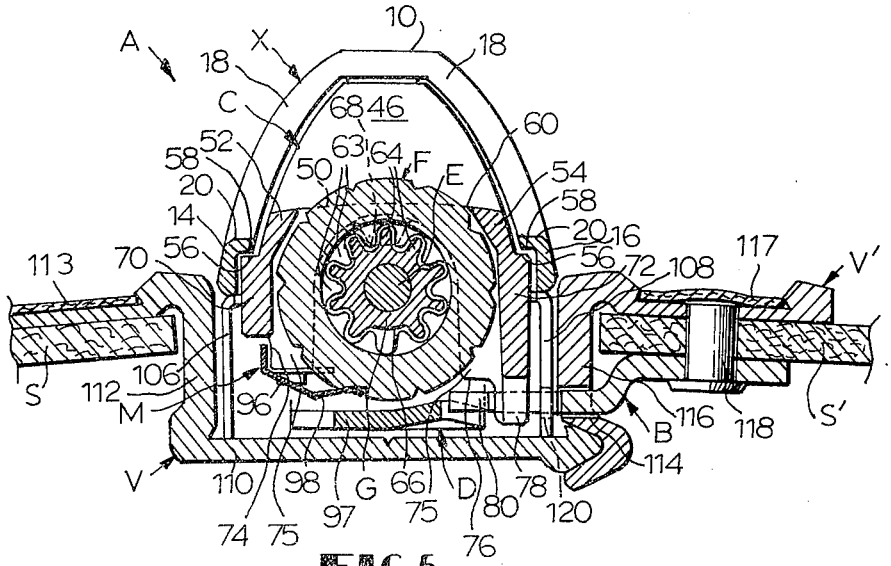
FIG. 5 is a transverse cross-sectional view taken approximately in the plane of line 5—5 of FIG. 1.

Top wall portions 10 and 12, side walls 14 and 16, connecting studs 24 and 26 and inner wall portions 27 of the handle stud cooperate with the planar horizontal end portions 34 and 35 of frame D to define a pair of longitudinally spaced, facing recesses 37 (FIG. 3) and 39 (FIG. 2) which receive opposite ends of puller C, which is adapted to be manually pushed or pulled. Referring to FIG. 2, the puller has studs 38 and 40, rectangular in horizontal cross-section, depending from longitudinally spaced, planar opposite end portions 42 and 44, respectively, of the top wall of the puller. Curvillinear top wall portions 46 and 48 slope upwardly away from opposite sides of a central rectilinear top wall portion 50 to merge with the end portions 42 and 44, respectively, of the top wall. The curvilinear top wall portions 46 and 48 provide surfaces which are manually engageable, as by the thumbs of the left and right hands, respectively, of the user, for moving the puller between the latching and unlatching positions, as described hereinafter. Referring to FIGS. 4 and 5, the puller also has a pair of transversely spaced, downwardly divergent side walls 52 and 54 depending from the top of the puller. As shown in FIG. 5, the height of these side walls is at its minimum adjacent the rectilinear central top wall portion 50.

Referring again to FIG. 2, central portion 50 of the top wall of the puller is provided with a plurality of longitudinally spaced slots 60 which receive respective combination dials F. These dials are rotatable with associated sleeve means G on longitudinally extending shaft E, which has its opposite ends slidably received in respective openings in vertical wall portions 61 and 62 of frame D. As shown in FIG. 5, each annular dial F has a number of teeth 63 equally spaced about the inner periphery thereof in interfitting engagement with teeth 64 on the outer periphery of the associated sleeve means G. Dial teeth 63 each have an axial dimension substantially less than the thickness of each dial and are located adjacent the left side of the dials, as shown in FIG. 2, whereas teeth 64 on sleeve means G each have an axial dimension greater than the thickness of each dial. Referring to FIG. 5, one of teeth 64 on each sleeve means is omitted to provide a "missing tooth" portion or flat portion 66. The missing tooth portion on the sleeves is adapted to be in receiving alignment with respective lugs 68, which project from the central top wall portion 50 of the puller adjacent slots 60 when the dials are on combination. The teeth 64 on one or more of the sleeve means are in blocking relation with respect to the associated lugs when the dials are off combination, as shown in FIGS. 2 and 5.

Referring to FIG. 5, depending from the central region of side walls 52 and 54 of the puller are downward extensions or walls 70 and 72, respectively, which extend longitudinally along both sides of the plurality of dials (FIG. 1), extension 72 having greater height than extension 70. These extensions are thicker than their associated side walls, providing upwardly facing shoulders 56 which are cooperably related to downwardly facing shoulders 58 provided by side walls 14 and 16 of the handle stud.

Referring to FIG. 1, the puller has four pairs of transversely spaced ribs 74 and 76 projecting toward each other from extensions 70 and 72, respectively, the four pairs of ribs being longitudinally spaced to be adjacent both sides of the three slots 60, which receive the dials. As shown in FIG. 5, ribs 74 are formed integrally with extension 70, side wall 52 and top wall portion 50 of the puller, the lower end of these ribs extending somewhat below the bottom edge of extension 70. Ribs 76 are formed integrally with extension 72, side wall 54 and top wall portion 50 of the puller, and do not extend below the bottom edge of extension 72 (shown in cross-section). The transverse edges of each of slots 60 in the puller cooperate with respective transverse surfaces of ribs 74 and 76 to provide planar abutment surfaces having the general shape of an inverted U, as shown in FIG. 5. The abutment surfaces are located adjacent the left and right sides of the dials and are designated 75 and 75', respectively, in FIG. 2. Referring to FIG. 5, these abutment surfaces provide clearance for the sleeve means G so that the abutment surfaces can be brought into contact with the dials while bypassing the sleeve means. As shown in FIG. 2, the right transverse surfaces of lugs 68 on the puller lie in the same planes as abutment surfaces 75. Ribs 74 and 76 extensions 70 and 72 thus provide a carriage for the dials, the interfitting tooth configurations of the dials and the sleeve means permitting the dials to be moved longitudinally with the puller relative to their associated sleeve means by the abutment surfaces when the dials are on combination, as described more fully hereinafter.

Referring to FIG. 1, a pair of longitudinally spaced lugs 78 (FIG. 5) and 78' (FIG. 4) project downwardly from extension 72 of the puller at the points where two of ribs 76 merge with that extension. These lugs engage respective hook portions 80 and 80' on double-hooked hasp B (FIG. 1) when the puller is in the latching position shown in FIGS. 1 and 2. Referring to FIGS. 1 and 5, resilient dial-cooperable indexing means M is secured to the bottom edges of ribs 74 of the puller by headed-over studs 96, the indexing means having a plurality of spring fingers 98 cooperable with respective dials for resiliently maintaining the dials in the selected circumferential positions.

Referring to FIG. 2, sleeve means G are biased into abutting end-to-end relationship on shaft E against a flange 82 near one end of the shaft by a coiled compression spring J which is carried at the other end of the shaft between the sleeve means and vertical wall 61 of the frame. Spring J acts through the sleeve means to urge flange 82 of the shaft against a shift lever K (described later) which in turn is urged against vertical wall 62 of the frame.

As shown in FIG. 2, leaf springs H bias balls L in respective openings 84 in end portions 34 and 36 of the frame into engagement with sloping camming surfaces 86 which are provided by lugs 38 and 40 of the puller. As a result, the left end of the puller at 88 is urged into engagement with connecting stud 24, thereby resiliently maintaining the puller in the latching position shown in FIG. 2.

Operation of the combination lock will now be described. When dials F are off combination, one or more of the sleeve means will have a tooth 64 positioned in alignment with an associated lug 68 on the puller, as shown in FIG. 2. The sleeve means cannot be moved rightwardly on shaft E, with the result that teeth 64 engage lugs 68 to block rightward movement of the puller from the latching position. When the dials are rotated to the opening combination, the missing tooth portions 66 (FIG. 5) of each sleeve means is brought into alignment with its associated lug 68 on the puller. With the teeth 64 of the sleeve means thus moved out of blocking relation with respect to lugs 68 so that the lugs 68 may be received by the aligned missing tooth portions 66, thumb pressure, as from the right hand, may be applied to curvilinear top wall 48 of the puller to move the puller, and the dials, rightwardly from the latching position toward the unlatching position of FIG. 3. Thus, lugs 78 and 78' on the puller are moved out of engagement with hook portions 80 and 80' of the hasp. This rightward movement of the puller from latching position is resiliently opposed by leaf springs H which are caused to flex downwardly from the frame during the first part of this movement by the action of cam surfaces 86 against balls L. However, during the last part of this movement, the balls are biased into engagement with additional camming surfaces 92 which slope in the opposite sense from camming surfaces 86, thereby urging the puller rightwardly into the latching position of FIG. 3. Dials F, which are moved longitudinally with the puller relative to their associated sleeve means G by abutment surfaces 75, assume the positions shown in FIG. 3, the left and center dials each being supported by or straddling two sleeve means and the right dial being supported by or straddling the right sleeve means and the tubular portion 90 of shaft lever K. Springs H and balls L cooperate with camming surfaces 92 of the puller to resiliently maintain the puller in the unlatching position, the right end of the puller at 94 being urged thereby against connecting stud 26. When the puller is in unlatching position, the dials cannot be rotated from the opening combination, because the missing tooth portions 66 of the sleeve means receive lugs 68 of the puller and teeth 64 on the sleeve means still engage dial teeth 63.

To re-engage the hasp, the puller is moved leftwardly to the latching position of FIG. 2 by applying thumb pressure, as from the left hand, to the curvilinear top wall 46 at the left end of the puller. Leaf springs H and balls L cooperate with camming surfaces 92 on the puller to resiliently oppose initial leftward movement of the puller, and are thereafter cooperable with camming surfaces 86 to urge the puller into latching position. During this movement of the puller, abutment surfaces 75' engage the dials to return them with the puller to the longitudinal positions shown in FIG. 2. The dials may then be rotated off combination to lock the puller in the latching position.

Figure 3:
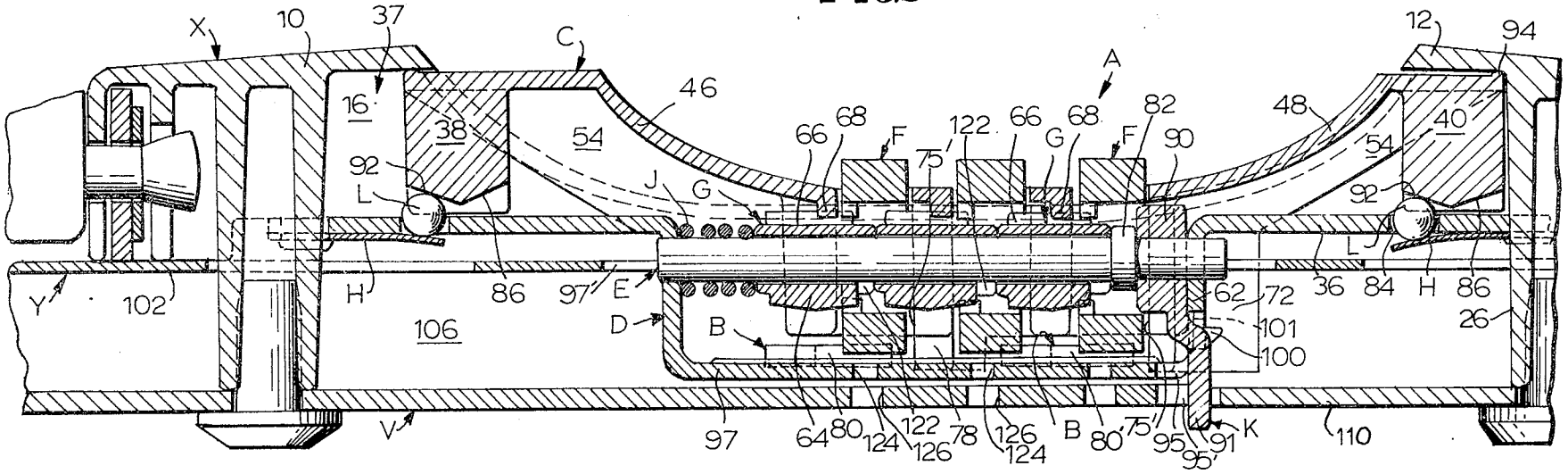
FIG.3 is a view similar to FIG. 2, but showing the relationship of parts when the puller is in unlatching position.

Referring to FIG. 2, shift lever K is mounted for pivotal movement on shaft E to enable selection of an opening combination of one's own choice. To establish a new opening combination, the dials are first turned to the old opening combination and the puller is then moved to the unlatching position of FIG. 3. Next, the shift lever arm lever 91, which extends through an opening 95 in horizontal central portion 97 and vertical wall 62 of frame D and through an opening 95' in wall 110 of valance member V (as shown in FIG. 3), is manually engaged to push the shift lever leftwardly against the force of coil spring J. The shift lever thus acts against flange 82 of shaft E to move the shaft and each sleeve means leftwardly for disengaging teeth 64 of the sleeve means from teeth 63 of their associated dials, top wall 102 of spaced y being cut away at 97' to provide clearance for the end of the shaft. Referring to FIG. 4, with the teeth thus disengaged, the shift lever is then rotated counterclockwise from the solid line position to the dotted line position, in which the lever arm 91 contacts the edge of opening 95. The lever arm is then released, spring J acting to move the shift lever rightwardly (as viewed in FIG. 3) by a small amount until a longitudinally extending projection 100 (FIGS. 1, 3 and 4) on shift arm lever 91 is received in a recess 101 in the left surface of vertical wall 62 of the frame. The sleeve means are thus held out of keyed engagement with the dials so that the dials may be rotated relative to the sleeve means to a new opening combination of one's own choice. Afterwards, the shift lever arm is pushed against the force of spring J, rotated counterclockwise and then released to return the shift lever to the position shown in FIG. 3, in which the sleeve means are again keyed for rotation with their associated dials. The lock is then ready for use with the new combination.

Referring to FIGS. 1 and 2, when applied to a luggage case, the handle stud X employing the combination lock of the invention may rest upon the top wall 102 of a longitudinally extending spacer Y which forms part of the luggage case. As shown in FIG. 4, the spacer has transversely spaced side walls 106 and 108 which support top wall 101 in spaced parallel relation to the bottom or horizontal wall 110 of a male valance member V. The hollow connecting studs 24 and 26 of the handle stud receive tapered rivets 109 through respective openings in wall 110 of the valance member, as shown in FIG. 2, thereby securing the handle stud against the top wall of the spacer. The vertical wall 112 (FIG. 5) of the valance member is suitably connected to the edge of luggage case section S and may include a decorative insert 113. Referring to FIG. 1, the hooked portions 80 and 80' of hasp B project through associated openings 114 (FIG. 5) in the vertical wall 116 of a female valance member V', which is suitably attached to the edge of cooperable luggage case section S' and which may include a decorative insert 117. For example, the valance member and the hasp may be mounted on the top and bottom surfaces, respectively, of luggage case section S' by a pair of headed-over rivets 118 (FIG. 1), as shown in FIG. 5. Of course, side wall 108 of washer Y has openings 120 (FIG. 5) for receiving the hooked portions 80 and 80' of the hasp.

Each sleeve means G may be provided with an indicator or slot 122 (FIG. 3) which is adapted to be felt or viewed through aligned openings 124 and 126 in the central horizontal portion 77 of frame D and valance member V, respectively, for determining a "lost" combination when the luggage case sections are not locked together, that is, when the underside of the lock is still accessible.

Referring to FIG. 2, each end, only one being shown, of a handle Z for hanlde stud X has a headed-over, longitudinally extending stud 130 carrying a washer assembly 132. The handle is connected to the handle stud by positioning the washer assembly between the associated outer end wall 22 and inner end wall 23 of the handle stud, stud 130 being received by slots 134 and 136 in the outer and inner end walls, respectively.

When a combination lock in accordance with the invention is applied to the center of a luggage case section, either separately from the handle stud or as part of the handle stud in accordance with the invention, the puller may be easily actuated from unlatched to latching position and from latching position to unlatching position by thumb pressure from the left and right hands, respectively, when the hands are positioned on opposite sides of the lock. As a result, the hands may be placed on the case on opposite sides of the lock to enable the luggage case sections to be drawn together by the force between the palm and fingers of both hands, which may be necessary if the case is overpacked, thereby enabling the puller to be conveniently moved to latching position by thumb pressure without requiring that the hands be moved from those positions.

It is believed that the advantages and improved results furnished by the combination lock and handle stud of the invention will be apparent from the foregoing description of a preferred embodiment of the invention. Various changes and modifications may be made without departing from the spirit and scope of the invention as sought to be defined in the following claims.

I claim:

1. A combination lock cooperable with a hasp, the lock comprising a longitudinally movable puller having means for engaging the hasp and having a plurality of longitudinally spaced slots each receiving a rotatable dial, the dials being longitudinally movable with the puller, and a sleeve for each dial rotatable therewith, the dials and the sleeves having cooperable means permitting movement of a dial longitudinally relative to its associated sleeve, the sleeves being cooperable with means provided by the puller for blocking movement of the puller from latching position when the dials are off combination and for permitting movement of the puller between latching and unlatching positions when the dials are on combination.

2. A combination lock as set forth in Claim 1, wherein the slots are provided in a central portion of the puller, and wherein opposite end portions of the puller are formed for manual engagement.

3. A combination lock as set forth in Claim 1, wherein the puller has dial carriage means for moving the dials longitudinally with the puller, the carriage means comprising a pair of transversely spaced longitudinal outer walls having the dials therebetween and longitudinally spaced inner ribs extending transversely from the outer walls adjacent to both sides of each dial.

4. A combination lock as set forth in Claim 3, wherein the means for engaging the hasp comprises a lug projecting from the carriage means.

5. A combination lock as set forth in Claim 1, wherein the puller has a dead bolt action, and wherein the lock further comprises means for resiliently maintaining the puller in the latching and unlatching positions, respectively.

6. A combination lock as set forth in Claim 1, wherein the cooperable means of the dials and sleeves are interfitting teeth; wherein each sleeve has a missing tooth portion; and wherein the means provided by the puller comprises spaced lugs cooperable with respective sleeves, a tooth on a sleeve being engageable with a lug for blocking movement of the puller from unlactching position when the dials are off combination, the lugs being receivable by the missing tooth portions of their associated sleeves when the dials are on combination for permitting movement of the puller to the unlatching position.

7. A combination lock as set forth in Claim 6, wherein the dials are generally annular in shape and have the dial teeth formed on the inner periphery thereof, the axial dimension of the dial teeth being less than the thickness of each dial and the axial dimension of the teeth on each sleeve being greater than the thickness of each dial.

8. A combination lock as set forth in Claim 6, wherein the sleeves are biased into abutting end-to-end relation on a longitudinally extending shaft by spring means, and wherein the lock further comprises a shift lever mounted at one end of the shaft for moving the shaft longitudinally against the force of the spring means to disengage the teeth on the sleeves from the teeth on their associated dials.

9. A handle stud for a luggage case or the like, including a combination lock comprising a longitudinally extending shaft, a plurality of dials keyed for rotation about the shaft with associated sleeves, each dial and is respective sleeve having interfitting teeth which permit longitudinal movement of each dial relative to its associated sleeve, and a longitudinally movable puller having means for engaging a cooperable hasp, the puller having a central portion with longitudinally spaced slots receiving respective dials which are longitudinally movable with the puller and having portions on opposite sides of the central portion formed for manual engagement, the puller further having means cooperable with the sleeves for blocking movement of the puller from latching position when the dials are off combination and for permitting movement of the puller between latching position and unlatching position when the dials are on combination, the handle stud having longitudinally spaced, facing recesses for receiving the opposite ends of the puller.

10. A handle stud as set forth in Claim 9, wherein the manually engageable end portions of the puller slop upwardly away from the central portion of the puller.

11. A handle stud as set forth in Claim 9, wherein the handle stud includes means for biasing the opposite ends of the puller into their respective recesses to resiliently maintain the puller in the latching and unlatching positions, respectively.

* * * * *